US006957948B2

(12) United States Patent
Brooks et al.

(10) Patent No.: US 6,957,948 B2
(45) Date of Patent: Oct. 25, 2005

(54) TURBINE BLADE ATTACHMENT LIGHTENING HOLES

(75) Inventors: Tom Brooks, Hobe Sound, FL (US); Richard Seleski, Palm Beach Gardens, FL (US); Thomas Churbuck, Boca Raton, FL (US); Thomas E. Brew, Jr., Boca Raton, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 60 days.

(21) Appl. No.: 10/761,766

(22) Filed: Jan. 21, 2004

(65) Prior Publication Data

US 2005/0158174 A1 Jul. 21, 2005

(51) Int. Cl.[7] ..... F01D 5/18
(52) U.S. Cl. ..... 416/96 R; 416/189; 416/239
(58) Field of Search ..... 416/96 R, 97 R, 416/189, 239; 415/115

(56) References Cited

U.S. PATENT DOCUMENTS 5,352,092 A 10/1994 Ferleger et al.
5,354,178 A 10/1994 Ferleger et al.
5,836,742 A 11/1998 Dierksmeier et al.
5,839,882 A 11/1998 Finn et al.
5,980,209 A * 11/1999 Barry et al. ..... 416/223 A
6,241,471 B1 * 6/2001 Herron ..... 415/190
6,390,775 B1 * 5/2002 Paz ..... 416/193 A
6,491,498 B1 12/2002 Seleski et al.

* cited by examiner

*Primary Examiner*—Ninh H. Nguyen

(57) ABSTRACT

The present invention seeks to provide a turbine blade with increased creep capability for both uncooled and cooled turbine blades while generally maintaining operating stress levels at an interface region between the turbine blade and a turbine disk. A turbine blade is disclosed having an attachment, a neck, a platform, and an airfoil. Extending radially outward from the attachment, through the neck, and terminating radially inward of the platform is a plurality of first cavities. The turbine blade in accordance with the preferred embodiment of the present invention is cast from a high density nickel base alloy with high temperature capability and improved creep capability. A plurality of first cavities are placed in the attachment and neck region to reduce excess weight of the turbine blade due to the higher density, greater creep capable alloy. Reducing the weight of the blade in this region provides increased creep capability in the turbine blade airfoil while maintaining operating stress levels.

9 Claims, 7 Drawing Sheets

A——— – ——— – ——— – ——— – ———A

TURBINE BLADE ATTACHMENT LIGHTENING HOLES

TECHNICAL FIELD

This invention relates to turbine blades used in a gas turbine engine and more specifically to a turbine blade having improved resistance to creep while not adversely affecting the load on a turbine disk.

BACKGROUND OF THE INVENTION

A typical gas turbine engine contains an inlet, compressor, combustor, turbine, and exhaust duct. Air enters the inlet and passes through the compressor, with each successive stage of the compressor raising the pressure and temperature of the air. The compressed air mixes with fuel in the combustor and undergoes a chemical reaction to form hot combustion gases that pass through the turbine. The turbine, which contains a series of alternating stages of rotating blades and stationary vanes, is coupled to drive the compressor through a common rotor. As the hot combustion gases pass through the turbine, the thermal energy is converted into mechanical work by turning each stage of turbine blades that are contained within a disk, which is coupled to the rotor. The number of turbine blades forming each stage varies depending on location within the turbine and size of the turbine blades. Depending on the operating temperatures of the turbine, the turbine blades may or may not be cooled. Typically, the stages of the turbine closest to the combustor are cooled, with the aft most stages of the turbine uncooled.

Turbine blades are subject to both the elevated temperatures of hot gases exiting the combustor, as well as high mechanical stresses from rotational forces. A turbine blade that is exposed to each of these conditions for a prolonged time begins to creep or expand radially. Turbine blade creep is a result of plastic deformation occurring along the grain boundaries of the casting. When the thermal and mechanical loads on the turbine blade are released, the turbine blade cools and contracts. However, over time, complete contraction to the original grain structure does not occur and the deformation is permanent. A limited amount of permanent deformation is permissible before replacement of the turbine blade is required.

The creep rate can be reduced either by lowering the operating temperature or improving the resistance to creep. A common manner to accomplish the first option is to cool the turbine blades. However, cooling a turbine blade requires a more complex blade design that results in more costly manufacturing techniques. Furthermore, cooling a turbine blade requires using compressed air to cool the internal cavities of a turbine blade. This compressed air bypasses the combustion process and removes fluid that would drive the turbine, thereby reducing the overall efficiency of the turbine.

What is needed is a more cost effective means to reduce the creep rate of turbine blades, for both cooled and uncooled turbine blades, while not reducing the life of the blade attachment or turbine disk.

SUMMARY AND OBJECTS OF THE INVENTION

The present invention seeks to provide a turbine blade, cooled or uncooled, having an improved resistance to creep while generally maintaining operating stress levels at an interface region between the turbine blade and a turbine disk. A gas turbine blade is disclosed having an attachment, a neck fixed to the attachment and extending radially outward from the attachment, a platform fixed to the neck opposite of the attachment, and an airfoil projecting radially outward from the platform. Located within the turbine blade and extending radially outward from the attachment, through the neck, and terminating radially inward of the platform is a plurality of first cavities.

The turbine blade in accordance with the preferred embodiment of the present invention is uncooled and cast from a high density nickel base alloy with high temperature capability. The material, while having a higher density than alloys used in prior art turbine blades, also has the benefit of a higher creep capability, or resistance to creep, for the airfoil section of the turbine blade. However, the increase in creep capability does not come without a drawback. The higher density of the alloy, for the same blade structure, has a greater weight, and therefore results in a greater radial pull or load on the turbine blade attachment and corresponding turbine blade disk. The greater load applied to the turbine blade attachment and turbine blade disk results in higher stresses and lower component life. The present invention compensates for this load increase, and corresponding higher stress, by incorporating a plurality of first cavities that extend generally radially outward from the bottom of the attachment, through the neck, and terminating radially inward of the platform. These first cavities remove excess material from the blade attachment and neck regions, which lowers the overall weight of the turbine blade, and its corresponding load on the turbine disk, when in operation. The first cavities terminate radially inward of the platform so as to not adversely affect the load carrying area of the airfoil. Geometric specifics regarding the plurality of first cavities are also disclosed.

This invention can also be applied to a cooled turbine blade as is disclosed in an alternate embodiment of the present invention.

It is an object of the present invention to provide a turbine blade having improved resistance to creep while maintaining mechanical load and stress levels on the interface region between a turbine blade attachment and mating turbine disk.

In accordance with these and other objects, which will become apparent hereinafter, the instant invention will now be described with particular reference to the accompanying drawings.

DETAILED DESCRIPTION OF THE PREFERRED EMBODIMENT

Figure 1:
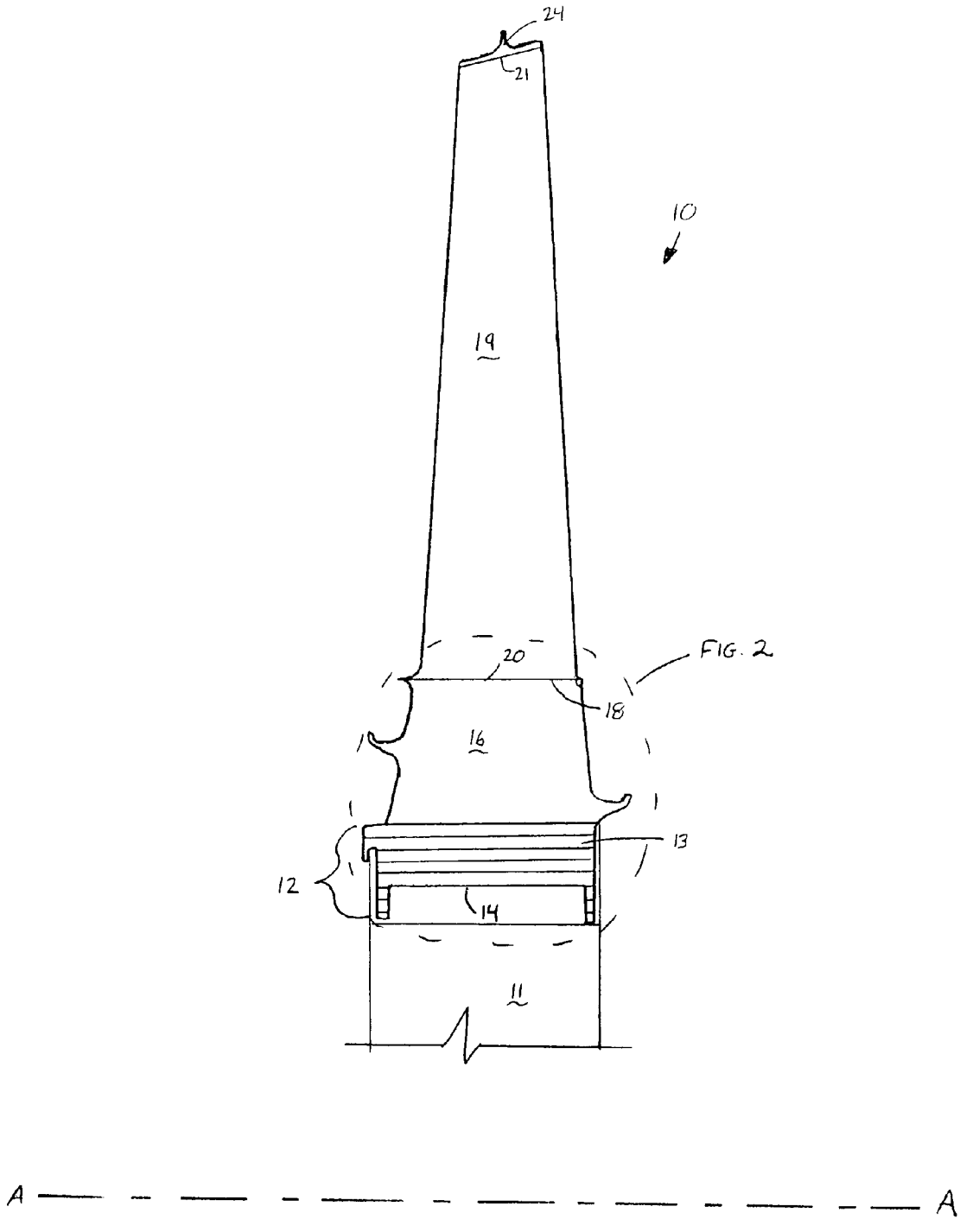
FIG. 1 is an elevation view of a turbine blade and portion of a turbine disk in accordance with the preferred embodiment of the present invention.

Referring to FIG. 1, a turbine blade 10, in accordance with the preferred embodiment, is shown in a portion of a turbine disk 11 for rotation about an axis A—A in a turbine section of a gas turbine engine. Turbine blade 10 has been configured to have an increased resistance to creep while generally maintaining operating stress levels at interface region 12 between turbine blade 10 and mating turbine disk 11.

Figure 2:
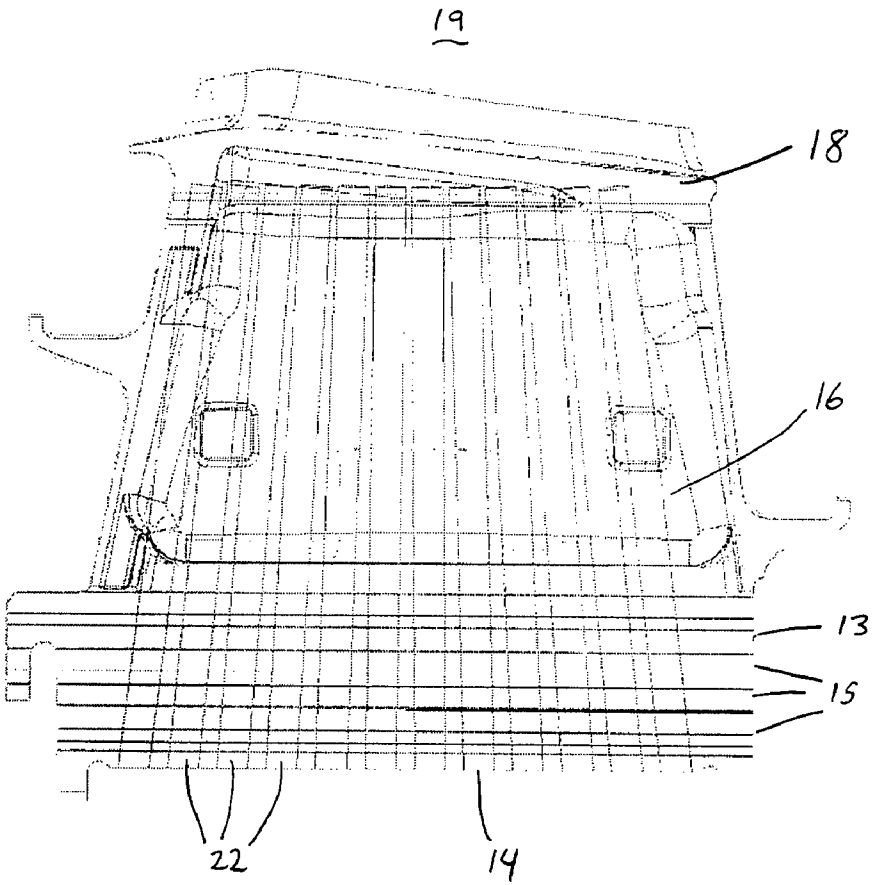
FIG. 2 is an elevation view of a portion of a turbine blade in accordance with the preferred embodiment of the present invention.

Referring now to FIGS. 1 and 2, turbine blade 10 comprises an attachment 13 having a generally planar first surface 14 parallel to axis A—A and a plurality of axially extending serrations 15 for engagement with turbine disk 11. Extending generally radially outward from and fixed to attachment 13 is neck 16, which has a region of minimum thickness 17 (see FIG. 3). Referring back to FIG. 1, a platform 18 is fixed to and extends generally radially outward from neck 16. Extending generally radially outward from platform 18 is an airfoil 19 having a first end 20 and a second end 21 in spaced relation, with first end 20 fixed to platform 18. In order to account for the increase in blade weight due to the higher density, high temperature nickel base material for improved creep resistance, a plurality of first cavities 22 extend generally radially outward from attachment first surface 14 through attachment 13, and into neck 16, such that first cavities 22 terminate radially inward of platform 18 (see FIG. 2). In this manner, first cavities 22 remove excess weight from turbine blade 10 without adversely effecting the load distributions throughout the blade, especially in the airfoil portion.

Figure 3:
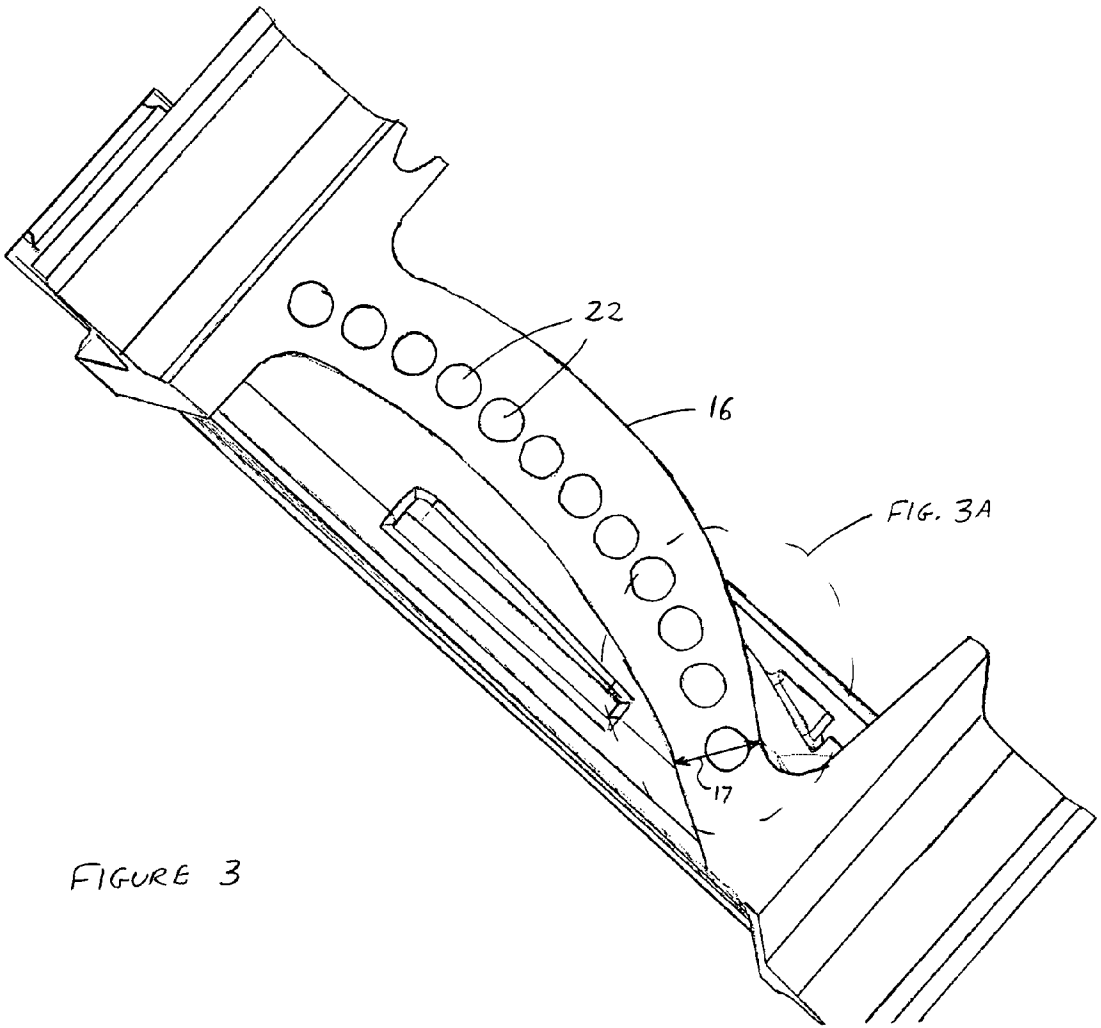
FIG. 3 is a cross section view taken through the neck portion of a turbine blade in accordance with the preferred embodiment of the present invention.
Figure 3A:
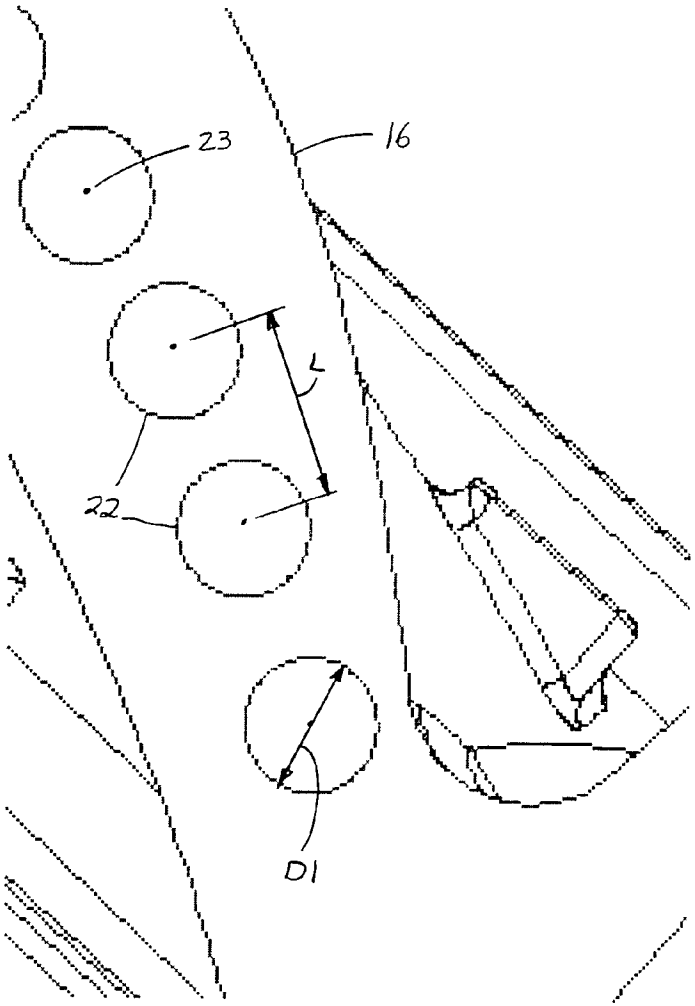
FIG. 3A is an enlarged cross section view of a portion of the neck region of a turbine blade in accordance with the preferred embodiment of the present invention.

Referring to FIGS. 3 and 3A, plurality of first cavities 22 each have a center 23, a first diameter D1 that is approximately 50%–75% of neck minimum thickness 17, and are located axially along attachment first surface 14 such that centers 23 are spaced apart by a length L that is approximately 1.5 times diameter D1. First cavities 22, which typically extend through attachment 13 and into neck 16, may vary in radial length depending on the first diameter D1 and amount of material necessary to remove in order to reduce the turbine blade weight, and corresponding disk stresses, to an acceptable level. Inserting first cavities 22 into turbine blade 10 during the casting process would be an extremely difficult process and could lead to casting flaws due to the relatively long length of first cavities 22 compared to first diameter D1. Therefore, the preferred manner in which to place first cavities 22 into turbine blade 10 is by either electro chemical machining or electrical discharge machining.

As an example, for a turbine blade having a minimum neck thickness 17 of 0.200 inches, first diameter D1 would preferably range between 0.100 inches and 0.150 inches, and first cavities 22 would be spaced apart by a length L of approximately 0.150 inches–0.225 inches. This spacing and diameter arrangement ensures a sufficient amount of the higher density material is removed from the turbine blade to lower the operating stresses while maintaining attachment integrity to support the turbine blade load in operation and not compromising its structure or durability.

The manner of reducing turbine blade weight for a turbine blade cast from a relatively high density nickel base alloy having high temperature capability is independent of the turbine blade structure. Although not a requirement of the present invention, turbine blade 10 could also include a shroud 24 that would be fixed to second end 21 of airfoil 19, opposite platform 18. Shrouds are typically found on longer turbine blades for dampening purposes.

Figure 4:
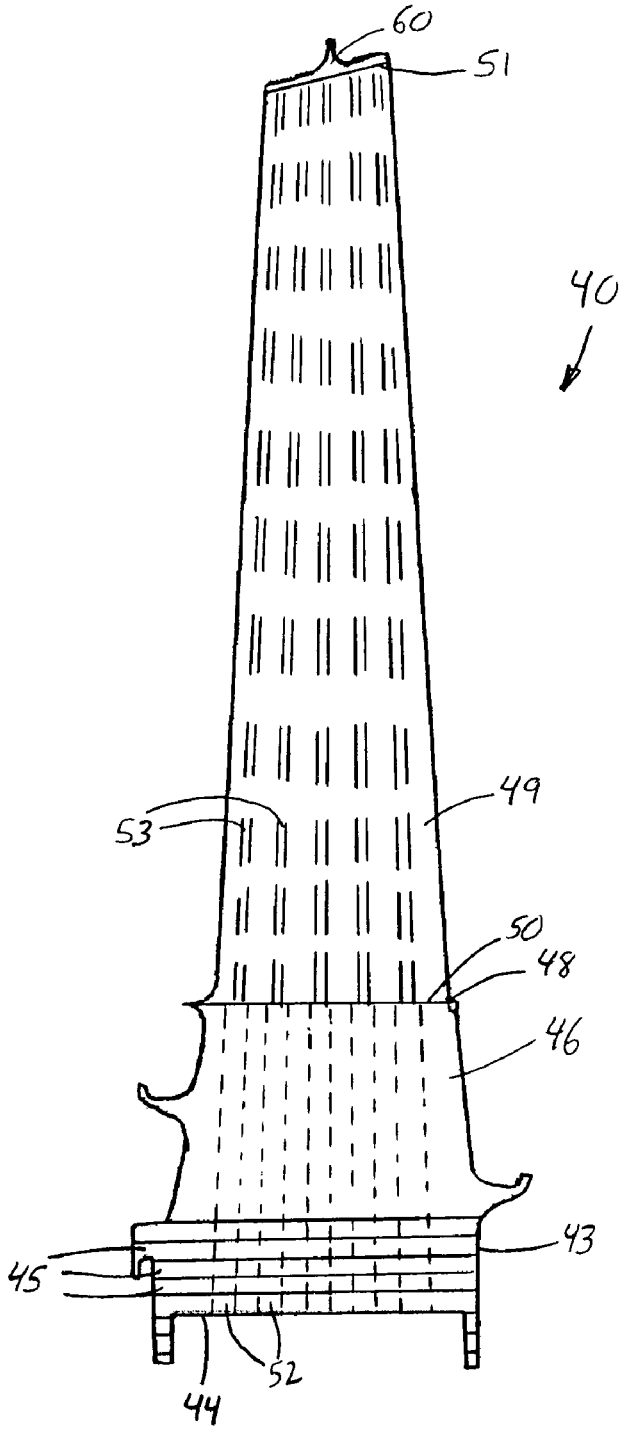
FIG. 4 is an elevation view of a turbine blade in accordance with an alternate embodiment of the present invention.
Figure 5:
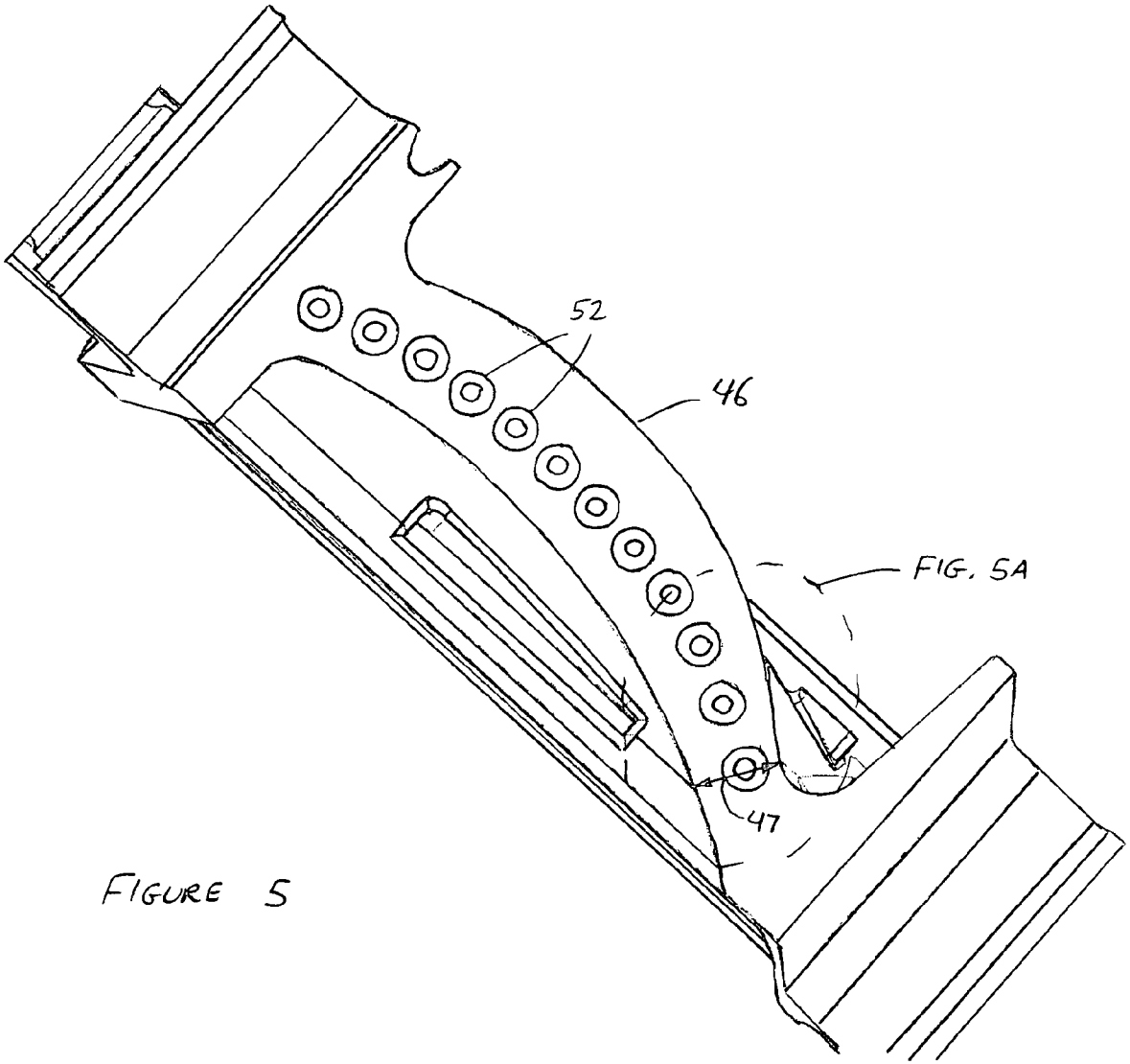
FIG. 5 is a cross section view through the neck portion of a turbine blade in accordance with an alternate embodiment of the present invention.
Figure 5A:
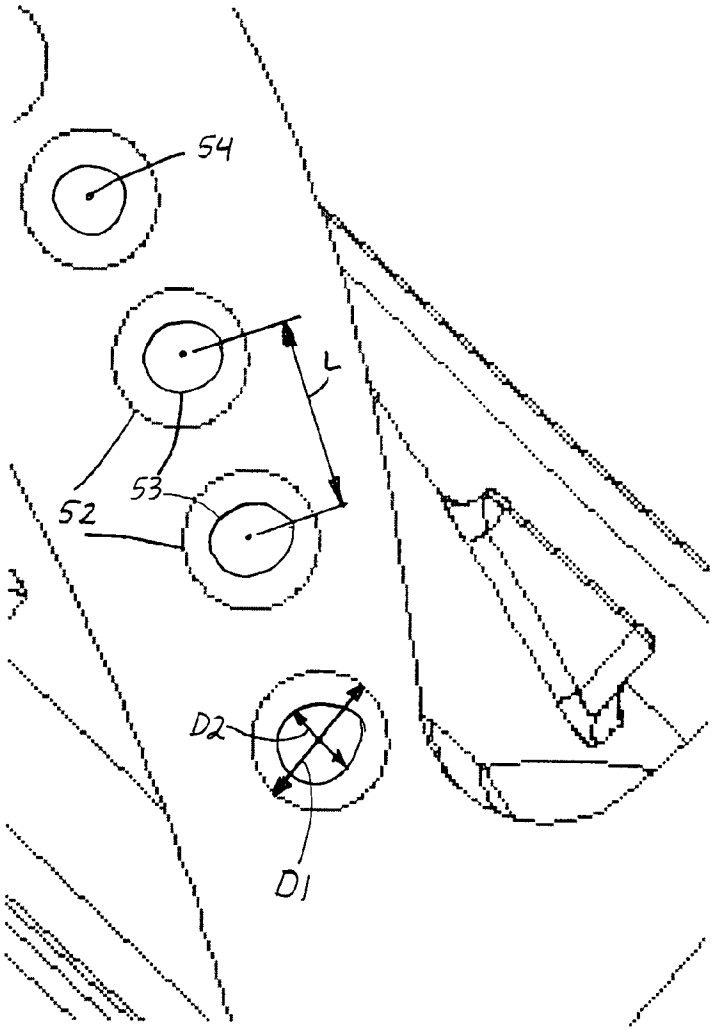
FIG. 5A is an enlarged cross section view of a portion of the neck region of a turbine blade in accordance with an alternate embodiment of the present invention.

An alternate embodiment of the present invention is shown in FIGS. 4–5A and includes all of the features of the preferred embodiment of the present invention, plus an additional feature of dedicated airfoil cooling. Turbine blade 40 comprises an attachment 43 having a generally planar first surface 44 parallel to axis A—A and a plurality of axially extending serrations 45 for engagement with a turbine disk. Extending generally radially outward from and fixed to attachment 43 is neck 46, which has a region of minimum thickness 47 (see FIG. 5). Referring back to FIG. 4, a platform 48 is fixed to and extends generally radially outward from neck 46. Extending generally radially outward from platform 48 is an airfoil 49 having a first end 50 and a second end 51 in spaced relation, with first end 50 fixed to platform 48. In order to account for the increase in blade weight due to the higher density, high temperature nickel base material for improved creep resistance, a plurality of first cavities 52 extend generally radially outward from attachment first surface 44 through attachment 43, and into neck 46, such that first cavities 52 terminate radially inward of platform 48. In this manner, first cavities 52 remove excess weight from turbine blade 10 without adversely effecting the load distributions throughout the blade, especially in the airfoil portion. Extending generally radially outward from plurality of first cavities 52 and in fluid communication therewith is a plurality of first cooling holes 53, which extend through platform 48 and airfoil 49 to provide cooling to airfoil 49.

Referring to FIGS. 5 and 5A, plurality of first cavities 52 each have a center 54, a first diameter D1 that is approximately 50%–75% of neck minimum thickness 47, and are located axially along attachment first surface 44 such that centers 54 are spaced apart by a length L that is approximately 1.5 times diameter D1. First cavities 52, which typically extend through attachment 43 and into neck 46, may vary in radial length depending on the first diameter D1 and amount of material necessary to remove in order to reduce the turbine blade weight, and corresponding disk stresses, to an acceptable level. Plurality of first cooling holes 53 share centers 54 with plurality of first cavities 52 as shown in FIG. 5 and each have a second diameter D2 that is smaller than first diameter D1. As one skilled in the art of turbine airfoil cooing will understand, the size of second diameter D2 depends on the amount cooling required for airfoil 49.

Inserting first cavities 52 and first cooling holes 53 into turbine blade 10 during the casting process would be an extremely difficult process and could lead to casting flaws due to the relatively long length of first cavities 52 and first cooling holes 53 compared to first diameter D1 and second diameter D2, respectively. Therefore, the preferred manner in which to place first cavities 52 and first cooling holes 53 into turbine blade 10 is by either electro chemical machining or electrical discharge machining.

As with the preferred embodiment, the spacing between cavities 52 ensures a sufficient amount of the higher density material is removed from the turbine blade to lower the operating stresses while maintaining attachment integrity to support the turbine blade load in operation and not compromise its structure or durability. Furthermore, designing the cavity and cooling hole configuration such that first cooling hole diameter D2 is smaller than cavity diameter D1 will ensure that an adequate supply of cooling air is available to cool airfoil 49 while also preventing locally thin walls in airfoil 49.

The manner of reducing turbine blade weight for a turbine blade cast from a relatively high density nickel base alloy having high temperature capability is independent of the turbine blade structure. Although not a requirement of the present invention, turbine blade 40 could also include a shroud 60 that would be fixed to second end 51 of airfoil 49, opposite platform 48. Shrouds are typically found on longer turbine blades for dampening purposes.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A turbine blade for rotation about an axis, said turbine blade having an increased resistance to creep while generally maintaining operating stress levels at an interface region between said turbine blade and a mating turbine disk, said turbine blade comprising:

an attachment having a generally planar first surface generally parallel to said axis and a plurality of axially extending serrations for engagement with said turbine disk;

a neck fixed to said attachment and extending generally radially outward from said attachment, said neck have a region of minimum thickness that is measured generally perpendicular to said axis;

a platform fixed to said neck and extending generally radially outward from said neck;

an airfoil having a first end and a second end in spaced relation, wherein said airfoil first end is fixed to said platform and said airfoil extends generally radially outward from said platform; and, a plurality of first cavities extending generally radially outward from said attachment first surface, through said attachment, and into said neck, such that said first cavities terminate radially inward of said platform, wherein said plurality of first cavities each have a center, a first diameter D1 that is 50%–75% of said neck minimum thickness, and are located axially along said attachment first surface such that said centers are spaced apart by a length L, wherein said length L is approximately 1.5 times diameter D1.

2. The turbine blade of claim 1 wherein said turbine blade is cast from a high density nickel base alloy having high temperature capability.

3. The turbine blade of claim 1 wherein said plurality of first cavities is machined into said turbine blade by electro chemical machining or electrical discharge machining.

4. The turbine blade of claim 1 further comprising a shroud fixed to said airfoil second end.

5. A turbine blade for rotation about an axis, said turbine blade having an increased resistance to creep while generally maintaining operating stress levels at an interface region between said turbine blade and a mating turbine disk, said turbine blade comprising:

an attachment having a generally planar first surface generally parallel to said axis and a plurality of axially extending serrations for engagement with said turbine disk;

a neck fixed to said attachment and extending generally radially outward from said attachment, said neck have a region of minimum thickness that is measured generally perpendicular to said axis;

a platform fixed to said neck and extending generally radially outward from said neck;

an airfoil having a first end and a second end in spaced relation, wherein said airfoil first end is fixed to said platform and said airfoil extends generally radially outward from said platform;

a plurality of first cavities extending generally radially outward from said attachment first surface, through said attachment, and into said neck, such that said first cavities terminate radially inward of said platform, and wherein each of said plurality of first cavities have a center, a first diameter D1 that is 50%–75% of said neck minimum thickness, and are located axially along said attachment first surface such that said centers are spaced apart by a length L, wherein said length L is approximately 1.5 times diameter D1 and, a plurality of first cooling holes extending generally radially outward from said plurality of first cavities, through said platform, and said airfoil, and in fluid communication with said plurality of first cavities.

6. The turbine blade of claim 5 wherein said turbine blade is cast from a high density nickel base alloy having high temperature capability.

7. The turbine blade of claim 5 wherein each of said plurality of first cooling holes shares a center with a first cavity, and has a second diameter D2 that is smaller than said first diameter D1.

8. The turbine blade of claim 7 wherein said plurality of first cooling holes is machined into said turbine blade by electro chemical machining or electrical discharge machining.

9. The turbine blade of claim 5 further comprising a shroud fixed to said airfoil second end.

* * * * *